US011264229B1

(12) United States Patent
Lebedev

(10) Patent No.: US 11,264,229 B1
(45) Date of Patent: Mar. 1, 2022

(54) TIME-OF-FLIGHT MASS SPECTROMETER AND METHOD FOR IMPROVING MASS AND SPATIAL RESOLUTION OF AN IMAGE

(71) Applicant: Guennadi Lebedev, Petaluma, CA (US)

(72) Inventor: Guennadi Lebedev, Petaluma, CA (US)

( * ) Notice: Subject to any disclaimer, the term of this patent is extended or adjusted under 35 U.S.C. 154(b) by 0 days.

(21) Appl. No.: 17/512,253

(22) Filed: Oct. 27, 2021

Related U.S. Application Data

(60) Provisional application No. 63/205,321, filed on Dec. 3, 2020.

(51) Int. Cl.

| | |
|---|---|
| ***H01J 49/40*** | (2006.01) |
| ***H01J 49/06*** | (2006.01) |
| ***H01J 49/00*** | (2006.01) |
| ***H01J 49/24*** | (2006.01) |
| ***H01J 49/48*** | (2006.01) |
| ***H01J 49/42*** | (2006.01) |
| ***H01J 29/56*** | (2006.01) |

(52) U.S. Cl.
CPC ..... *H01J 49/40* (2013.01); *H01J 29/56* (2013.01); *H01J 29/566* (2013.01); *H01J 49/0004* (2013.01); *H01J 49/0031* (2013.01); *H01J 49/061* (2013.01); *H01J 49/067* (2013.01); *H01J 49/24* (2013.01); *H01J 49/406* (2013.01); *H01J 49/4245* (2013.01); *H01J 49/482* (2013.01); *H01J 49/486* (2013.01)

(58) Field of Classification Search
CPC .... H01J 49/40; H01J 49/0004; H01J 49/0031; H01J 49/061; H01J 49/067; H01J 49/24; H01J 49/406; H01J 49/4245; H01J 49/482; H01J 49/486; H01J 29/56; H01J 29/566
USPC ..... 250/287, 292
See application file for complete search history.

(56) References Cited

U.S. PATENT DOCUMENTS

| | | | | |
|---|---|---|---|---|
| 7,348,566 | B2 | 3/2008 | Tromp | |
| 9,048,071 | B2 | 6/2015 | Satoh | |
| 10,283,315 | B2 | 5/2019 | Tromp | |
| 10,734,208 | B2 | 8/2020 | Takeshita | |
| 10,741,376 | B2 | 8/2020 | Hoyes et al. | |
| 2010/0084549 | A1* | 4/2010 | Ermakov | H01J 49/4245 250/283 |

(Continued)

*Primary Examiner* — Kiet T Nguyen
(74) *Attorney, Agent, or Firm* — Steven A. Nielsen; www.NielsenPatents.com

(57) ABSTRACT

Disclosed embodiments include a time-of-flight mass spectrometer with a straight ion optical axis comprising: an ion gate is electrically insolated electrode on which applied voltages to reject/pass ions through ion gate, entrance module and exit module set in focus/mirror modes, and create ion optical image on image plane located in field view aperture, electrostatic object lens, entrance module in focus mode and, transport electrostatic lens, exit module in focus mode and projection lens focused and map ions from image plane of field view aperture to image plane of ion detector, projection lens configured to form ion optical image of sample holder on image plane of ion detector and ion optical components with corrected geometrical, chromatic and timed aberrations configured to compensate time arriving disturbance in image plane of ion detector and improve mass and spatial resolution of image on image plane of ion detector.

20 Claims, 11 Drawing Sheets

(56) References Cited

U.S. PATENT DOCUMENTS

2011/0240845 A1* 10/2011 Ding ..... H01J 49/027
250/282
2021/0013024 A1* 1/2021 Rusinov ..... H01J 49/0009

* cited by examiner

TIME-OF-FLIGHT MASS SPECTROMETER AND METHOD FOR IMPROVING MASS AND SPATIAL RESOLUTION OF AN IMAGE

CROSS-REFERENCE TO RELATED APPLICATIONS

This patent application claims priority benefit of U.S. Provisional Patent Application No. 63/205,321 filed on Dec. 3, 2020. The entire contents of the patent application are hereby incorporated by reference herein in its entirety.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

TECHNICAL FIELD

The disclosed subject matter relates generally to imaging mass spectrometry. More particularly, the invention relates to a time-of-flight mass spectrometer with ions optical components for correcting timing, chromatic, and geometrical aberrations to significantly improve mass and spatial resolution of an image on an image plane and method employed thereof.

KNOWN PRIOR ART

Imaging MS

U.S. Pat. No. 10,741,376 B2 August 2020 Hoyes et all

U.S. Pat. No. 9,048,071 B2 June 2015 Satoh et all

Aberr Corrected Mirror

U.S. Pat. No. 7,348,566 B2 March 2008 Tromp

U.S. Pat. No. 10,283,315 B2 August 2020 Tromp

U.S. Pat. No. 10,734,208 B2 August 2020 Takeshita

Articles

Mirror Aberration Corrections

Zhifeng Shao and Xiao Dong Wu. Properties of a four-electrode adjustable electron mirror as an aberration corrector. Review of Scientific Instruments, 61(4):1230-1235, 1990.

D Preikszas and H Rose. Correction properties of electron mirrors. Journal of Electron Microscopy, 46(1):1-9, 1997.

Marian Mankos, Khashayar Shadman, Alpha T N'diaye, Andreas K Schmid, Henrik H J Persson, and Ronald W Davis. Progress toward an aberration-corrected low energy electron microscope for DNA sequencing and surface analysis. Journal of vacuum science and technology. B, Nanotechnology & microelectronics: materials, processing, measurement, & phenomena: JVST B, 30(6): 6F402-6F402, 2012.

Multi-Pass Transmission Electron Microscope

Stewart A. Koppell et all., Design for a 10 keV Multi-Pass Transmission Electron Microscope. Ultramicroscopy Volume 207, December 2019, 112834

Marian Mankos et all., Electron optics for a multi-pass transmission electron microscope. Advances in Imaging and Electron Physics•September 2019

BACKGROUND

A time-of-flight analyzer ionizes a sample, accelerates the ions to fly in a space of a certain distance, measures the time required for the flight, and obtains mass to charge ratio of ions from the flight time. Time-of-flight (TOF) mass spectrometers are often used to determine the mass-to-charge ratio of ions based on time-of-flight along a flight path. In general, the longer the flight time, the easier is to discriminate the mass difference of sample ions. It is known several design approaches of imaging TOF mass spectrometers then imaging of the sample for selected ranges of ion mass evaporate and ionized from the sample by short-pulsed laser, ions or electrons beam. By scanning the electrons beam on the surface of the sample and recording the mass spectrum according to the beam position on the sample the image of the sample in mass spectral view is created. Such analyzers may have a low spatial resolution because it's defined by the size of the beam spot on the sample and it is in the range of a few microns.

For correction of chromatic timing aberration these instruments used different types of electrostatic mirrors there, their ion optical axis is curved and at most often it included toroidal or spherical electric sectors to transfer the resulting sample ions to a position-sensitive detector in a manner that provides a point-to-point imaging. Such electric sector-based TOF instruments have low order time-of-flight and spatial focusing aberrations and have multiple second-order aberrations that are not compensated for.

The Imaging mass spectrometers have two major parameters that allow for estimating its performance and nautical quality: the first is mass resolution on all fields of sample view, and the second is spatial resolution in all ranges of mass analyzed ions. The major impact in the first parameter has the time-of-flight ions from the sample to a detector plane, timing aberration due to the initial energy spread of ions on the sample, timing aberration due to the different length of ions trajectories started under different angles and distance from an optical axis of the ion optical system. The spatial resolution of imaging mass spectrometer with a position-sensitive detector is defined by aberrations of geometrical and chromatic aberration and ion-optical system of the analyzer. Correction of timing aberration by using in analyzer electrostatic mirrors condenser or sector kind significantly reduce timing aberration of first order but leave uncompensated high order timing and all geometrical aberrations.

A solution to this controversial problem lies in designing the ion optical system to include the ions optical components with a straight ion optical axis, there only a third order and higher of geometrical aberration is present and included the electrostatic axial symmetrical mirrors to compensate for timing and some geometrical aberration of the ion optical systems of the analyzer. Also, axial symmetrical mirrors have geometrical and timing aberration of different signs relative to axial symmetrical electrostatic lenses. The presence of electrostatic mirrors in the ion optical system with congestion with electrostatic lenses allows for compensating timing, chromatic and geometrical aberration of third and higher-order. This could significantly improve the analytical parameters of mass spectrometers.

Thus, there is an unmet need to provide a time-of-flight mass spectrometer with ions optical components for correcting timing, chromatic, and geometrical aberrations to significantly improve mass and spatial resolution of an image on an image plane and method employed thereof. Such innovative technologies and allied methodologies seek to preclude the disadvantages of conventional systems and their associated technologies.

SUMMARY

The present invention overcomes shortfalls in the related art by presenting an unobvious unique combination and configuration of methods and components to accept data in the form of text and pictures.

An objective of the present disclosure is directed towards a time-of-flight mass spectrometer that provides controlled delivery of specified gases to a sample cluster to create specific atmosphere and gas pressure on a sample surface.

Another objective of the present disclosure is directed towards the time-of-flight mass spectrometer that provides access for radiation source, pulse light or charge particle beam, to illuminate, evaporate and ionize a substance of sample from a sample surface.

Another objective of the present disclosure is directed towards the time-of-flight mass spectrometer that allows differential gas pumping in a vacuum chamber of spectrometers and allows creating the specified gas atmosphere and pressure in the sample vacuum cluster.

Another objective of the present disclosure is directed towards the time-of-flight mass spectrometer that allows for creating aberration-corrected images of the sample on the image plane of an ion detector.

Another objective of the present disclosure is directed towards the time-of-flight mass spectrometer that forms a geometrical and timely aberration-corrected image in a spatial and time-resolved detectors image plane.

Another objective of the present disclosure is directed towards the time-of-flight mass spectrometer allows setting mass range of the ions from the sample by setting specified modes of operation during the ion beam propagation.

In an embodiment of the present disclosure, the time-of-flight mass spectrometer with a straight ion optical axis comprising a vacuum chamber divided into a sample vacuum cluster, an objective lens vacuum cluster, and an ion formational and projection optical lens vacuum cluster.

In another embodiment of the present disclosure, the time-of-flight mass spectrometer comprising a sample holder configured to manipulate, heat, cool the sample vacuum cluster to provide access for a radiation source, pulse light or charged particle beam, to illuminate, evaporate and ionize a substance of the sample holder from the sample vacuum cluster.

In another embodiment of the present disclosure, the time-of-flight mass spectrometer comprising an electrostatic object lens from the objective lens vacuum cluster configured to extract, formation, and transport a plurality of ions of the sample holder from the sample vacuum cluster to an ion mirror trap of the ion formational and projection optical lens vacuum cluster.

In another embodiment of the present disclosure, the time-of-flight mass spectrometer comprising an ion gate is an electrically insolated electrode on which applied voltages allow to reject or pass the plurality of ions through an opening of the ion gate, the ion mirror trap comprises an entrance module and an exit module set in a focus mode or mirror mode, and a first transport electrostatic lens, and a second transport electrostatic lens configured to create an ion optical image on an image plane located in a plane of a field view aperture, the electrostatic object lens, the entrance module in the focus mode and the first transport electrostatic lens configured to guide and map the plurality of ions from the sample holder to the image plane of the field view aperture, the second transport electrostatic lens, the exit module in the focus mode and a projection lens focused and map the plurality of ions from the image plane of the field view aperture to an image plane of an ion detector, the projection lens configured to form an ion optical image of the sample holder on the image plane of the ion detector.

In another embodiment of the present disclosure, the time-of-flight mass spectrometer comprising a combination of focusing and mirroring ion-optical components with corrected geometrical, chromatic, and timed aberrations configured to compensate time arriving disturbance in the image plane of the ion detector and improve mass and spatial resolution of an image on the image plane of the ion detector, the combination of focusing and mirroring ion-optical components comprising the electrostatic object lens, the entrance module, the first electro statistic transport lens, the second electro statistic transport lenses, the exit module, and the projection lens.

BRIEF DESCRIPTION OF THE DRAWINGS

In the following, numerous specific details are set forth to provide a thorough description of various embodiments. Certain embodiments may be practiced without these specific details or with some variations in detail. In some instances, certain features are described in less detail so as not to obscure other aspects. The level of detail associated with each of the elements or features should not be construed to qualify the novelty or importance of one feature over the others.

Figure 1:
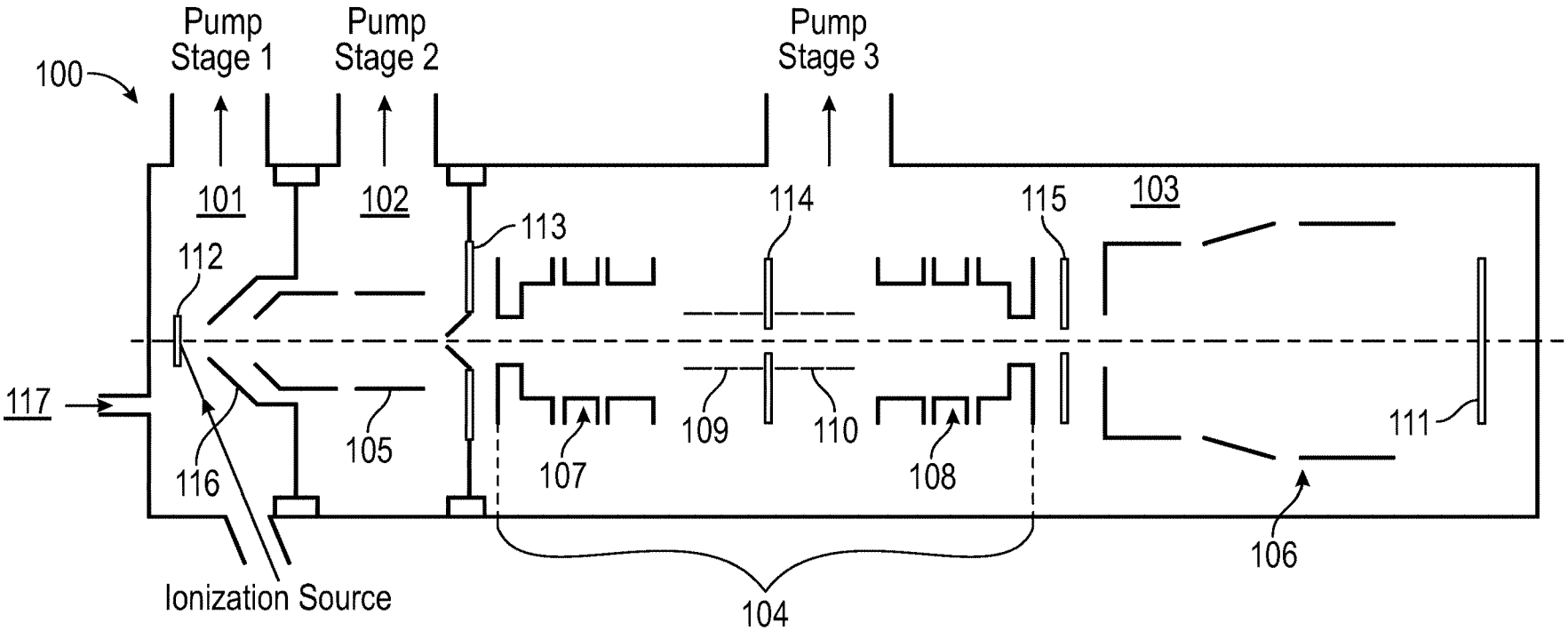
FIG. 1 is a diagram depicting a concept of differentially pumped vacuum chamber and a time-of-flight mass spectrometer, in accordance with one or more exemplary embodiments of the present disclosure.

These and other aspects of the present invention will become apparent upon reading the following detailed description in conjunction with the associated drawings.

REFERENCE NUMERALS IN THE DRAWINGS

FIG. 1, 100 discloses a differentially pumped vacuum chamber and a time-of-flight mass spectrometer
Sample Vacuum Cluster 101
Object Lens Vacuum Cluster 102
Projection Optical Lens Vacuum Cluster 103
Ion Mirror Trap 104
Entrance Module 107
Exit Module 108
First Transport Electrostatic Lens 109
First Transport Electrostatic Lens 110
ion detector 111
Electrostatic Object Lens 105
Projection Lens 106
Field View Aperture 114
Aperture 115

Figure 2:
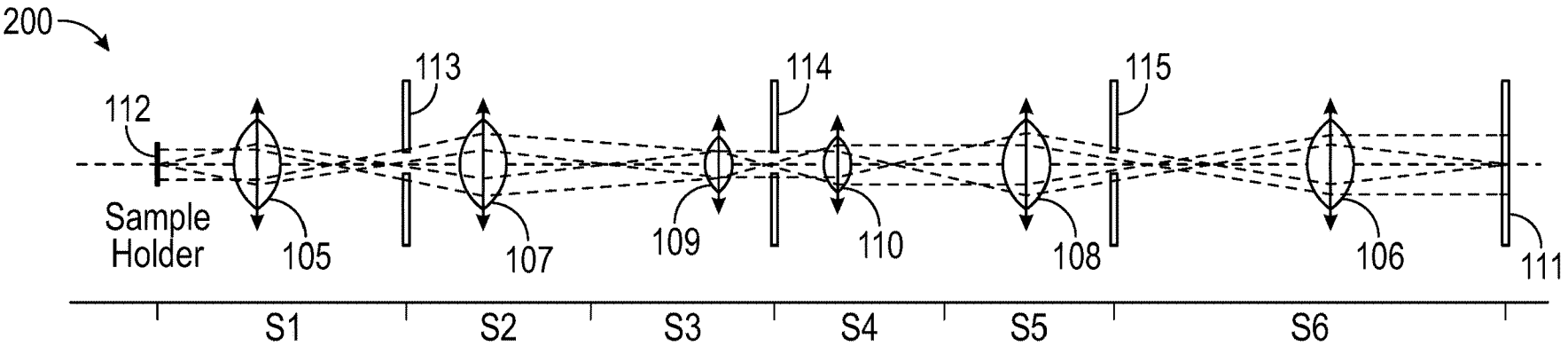
FIG. 2 is an ion optical schematic diagram depicting the time-of-flight mass spectrometer in a projection mode, in accordance with one or more exemplary embodiments of the present disclosure.

FIG. 2, 200, Time-Of-Flight Mass Spectrometer in A Projection Mode
Sample Holder 112
Electrostatic Object lens 105
Ion Gate 113
Field View Aperture 114
Transport Electrostatic Lens 110
Exit Module 108
Aperture 115
Projection Lens 106
Ion Detector 111

Figure 3:
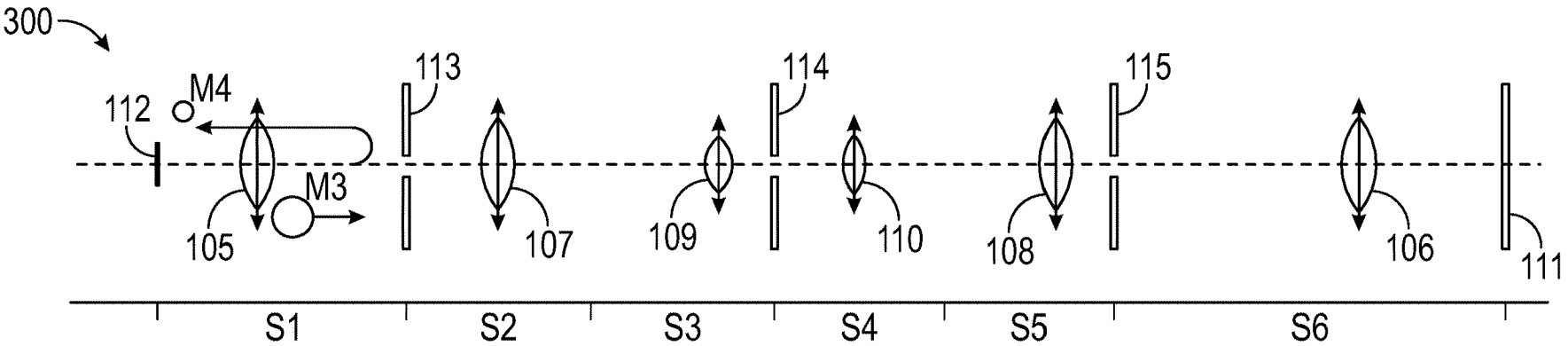
FIG. 3 is an ion optical schematic diagram depicting the time-of-flight mass spectrometer in a close mode of the ion gate, in accordance with one or more exemplary embodiments of the present disclosure.

FIG. 3, 300, discloses a Time-Of-Flight Mass Spectrometer in Close Mode of Ion Gate
Sample Holder 112
Ion Gate 113
Field View Aperture 114
Aperture 115
Projection Lens 106
Ion Detector 111

Figure 4:
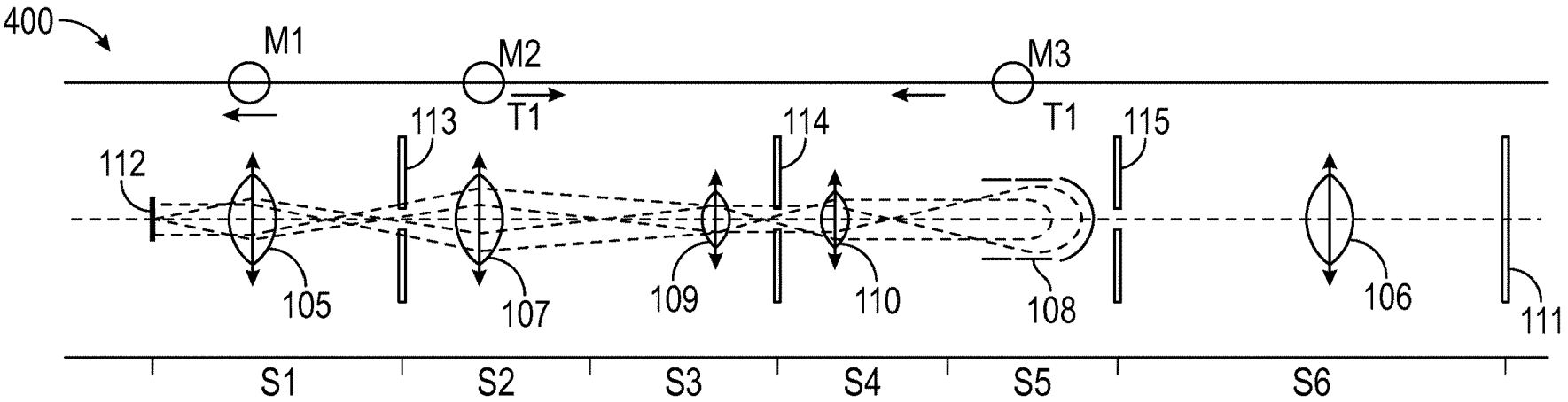
FIG. 4 is an ion optical schematic diagram depicting an time-of-flight mass spectrometer in an open mode of the ion gate, in accordance with one or more exemplary embodiments of the present disclosure.

FIG. 4, 400, discloses a Time-Of-Flight Mass Spectrometer in Open Mode of The Ion Gate
Sample Holder 112
Electrostatic Object lens 105
Ion Gate 113
Entrance Module 107
Field View Aperture 114
Transport Electrostatic Lenses 109, 110
Exit Module 108
Aperture 115
Projection Lens 106
Ion Detector 111

Figure 5:
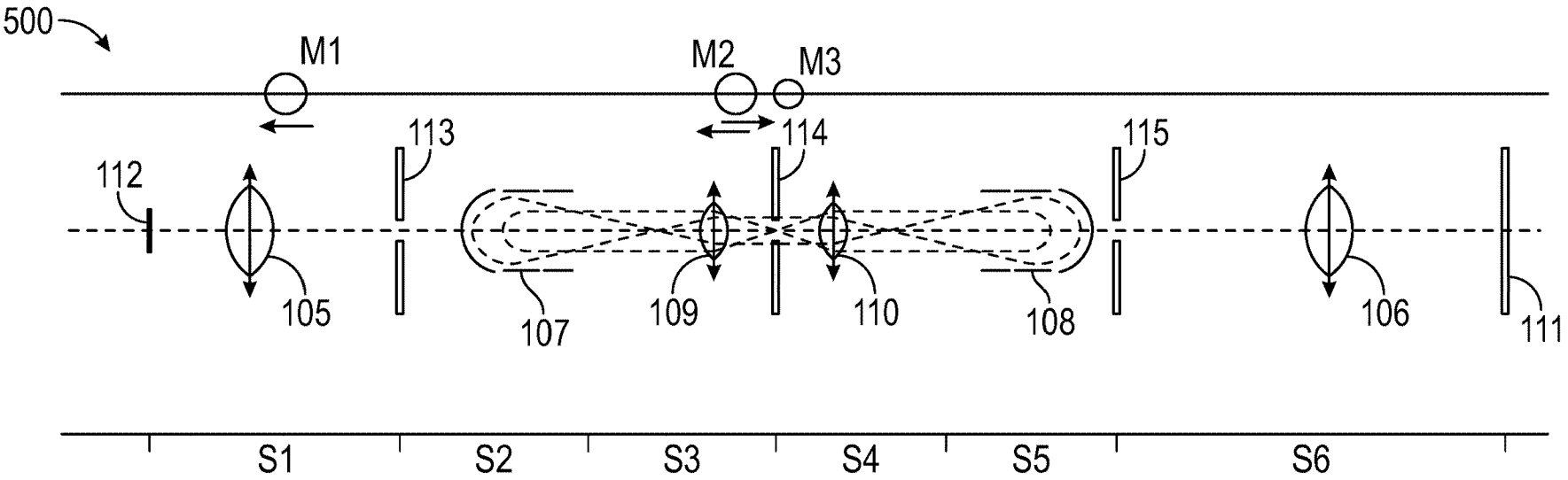
FIG. 5 is an ion optical schematic diagram depicting an time-of-flight mass spectrometer in the ion mirror trap bouncing mode, in accordance with one or more exemplary embodiments of the present disclosure.

FIG. 5, 500 discloses a Time-Of-Flight Mass Spectrometer in an Ion Mirror Trap Bouncing Mode
Sample Holder 112
Electrostatic Object lens 105
Ion Gate 113
Entrance Module 107
Field View Aperture 114
Transport Electrostatic Lenses 109, 110
Aperture 115
Exit Module 108
Projection Lens 106
Ion Detector 111

Figure 6:
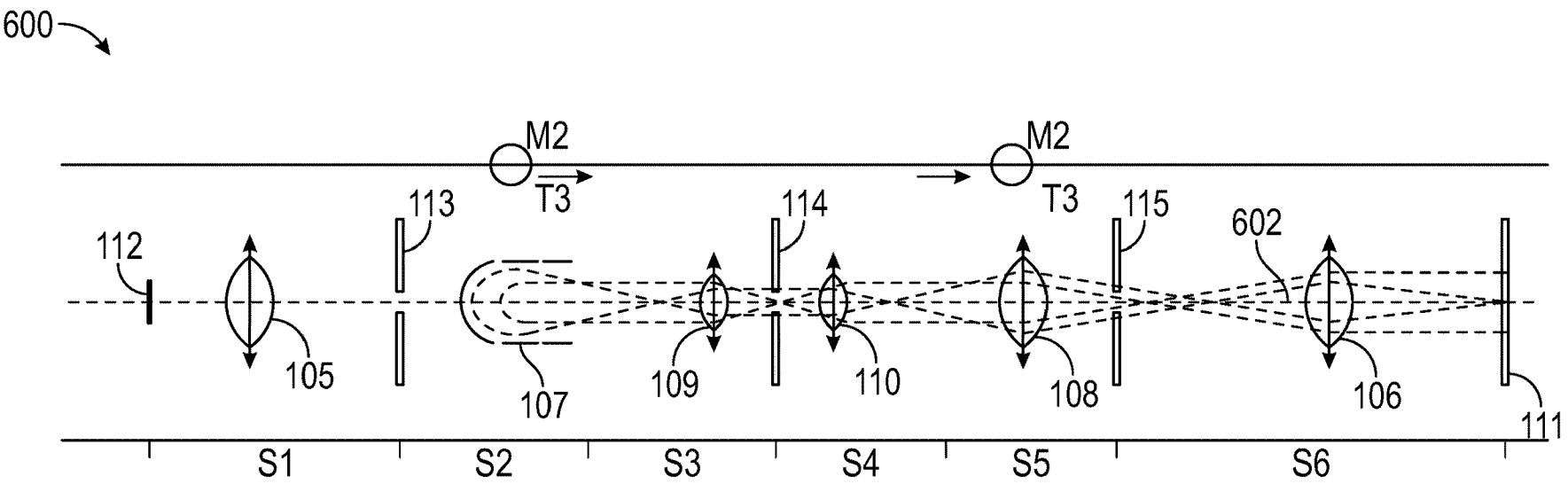
FIG. 6 is an example ion optical schematic diagram depicting the exit module of the ion mirror trap in the focusing mode and projection of an ion beam on an image plane of the ion detector, in accordance with one or more exemplary embodiments of the present disclosure.

FIG. 6, 600 discloses Exit Module of The Ion Mirror Trap in Focusing Mode and Projection of Ion Beam on An Image Plane of Ion Detector
Sample Holder 112
Electrostatic Object lens 105
Ion Gate 113
Entrance Module 107
Transport Electrostatic Lenses 109, 110
Exit Module 108
Aperture 115
Projection Lens 106
Ion Detector 111
Ion Beam 602

Figure 7:
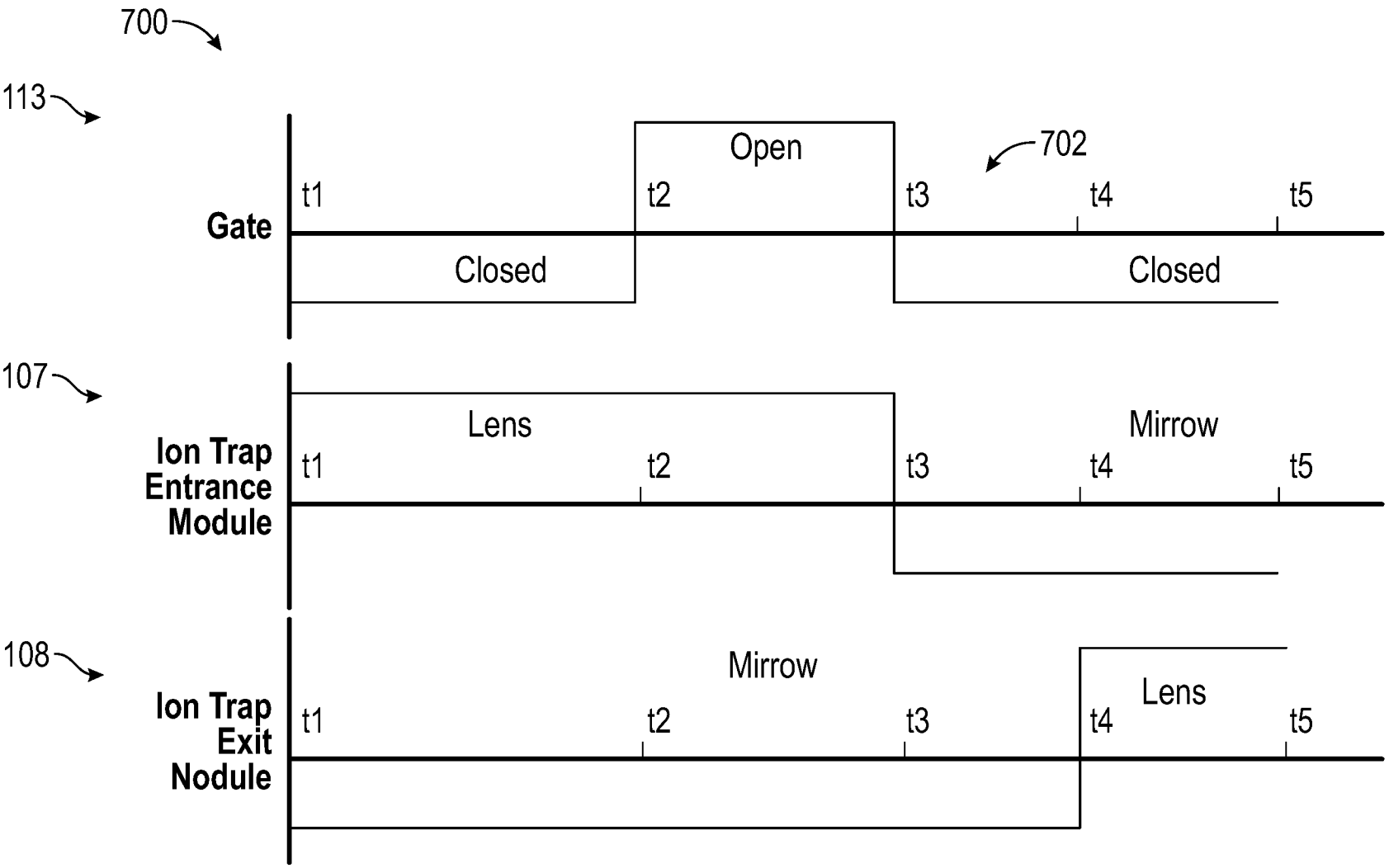
FIG. 7 is an example functionality diagram depicting an ion mirror trap on a time scale, in accordance with one or more exemplary embodiments of the present disclosure.

FIG. 7, 700 discloses a Functionality Diagram Depicting an Ion Mirror Trap on Time Scale
Ion Gate 113
Entrance Module 107
Exit Module 108
Time Scale 702

Figure 8:
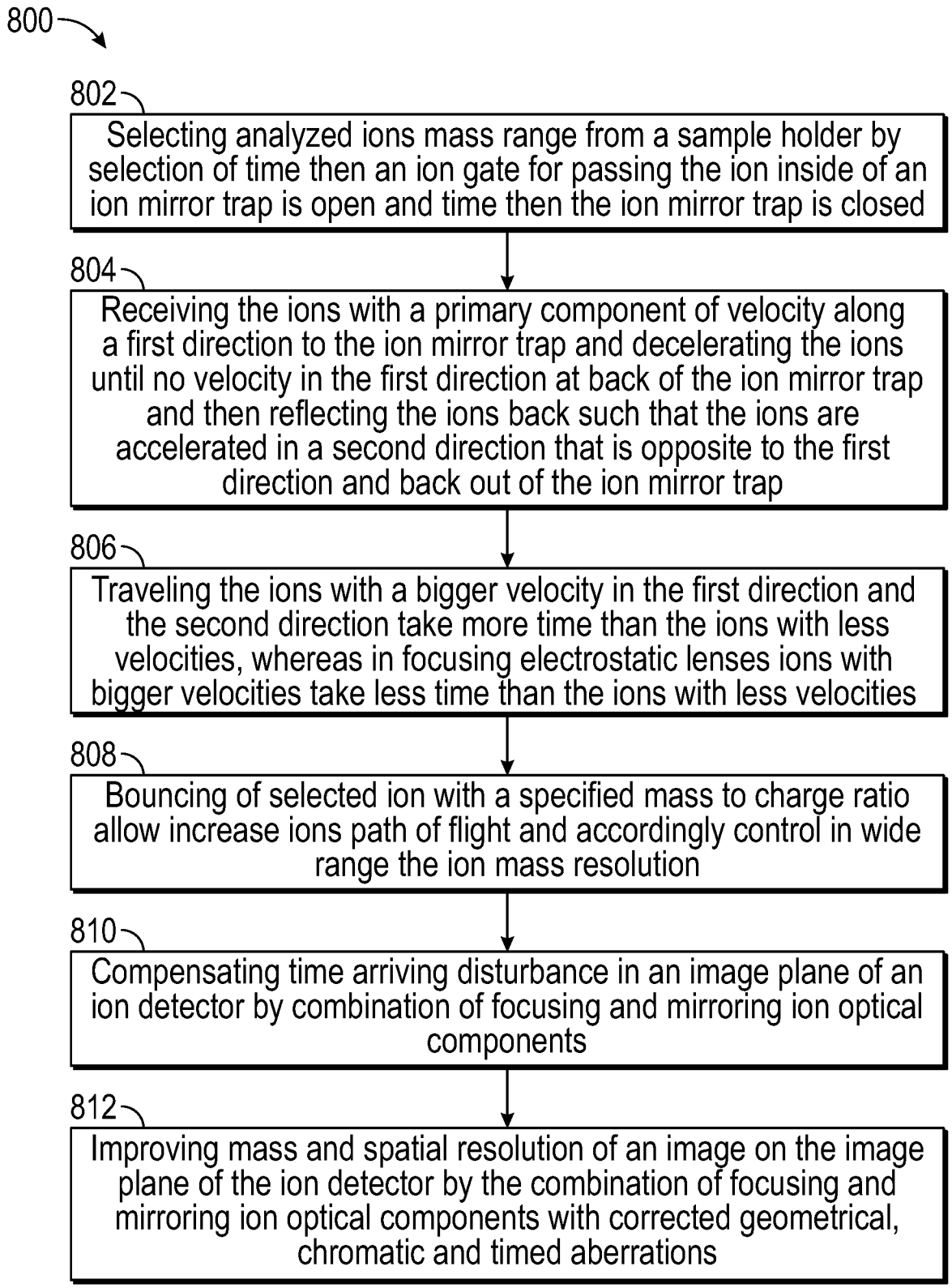
FIG. 8 is an example flow chart depicting a method for improving mass and spatial resolution of an image, in accordance with one or more exemplary embodiments of the present disclosure.

FIG. 8, 800 discloses a method for improving mass and spatial resolution of an image

802 Selecting analyzed ions mass range from a sample holder by a selection of time then an ion gate for passing the ion inside of an ion mirror trap is open and time then the ion mirror trap is closed

804 Receiving the ions with a primary component of velocity along a first direction to the ion mirror trap and decelerating the ions until no velocity in the first direction at the back of the ion mirror trap and then reflecting the ions back such that the ions are accelerated in a second direction that is opposite to the first direction and backs out of the ion mirror trap

806 Traveling the ions with a bigger velocity in the first direction and the second direction take more time than the ions with less velocities, whereas in focusing electrostatic lenses ions with bigger velocities take less time than the ions with lesser velocities

808 Bouncing of a selected ion with a specified mass to charge ratio allow increase ions path of flight and accordingly control in a wide range the ion mass resolution

810 Compensating time arriving disturbance in an image plane of an ion detector by a combination of focusing and mirroring ion-optical components

Figure 9:
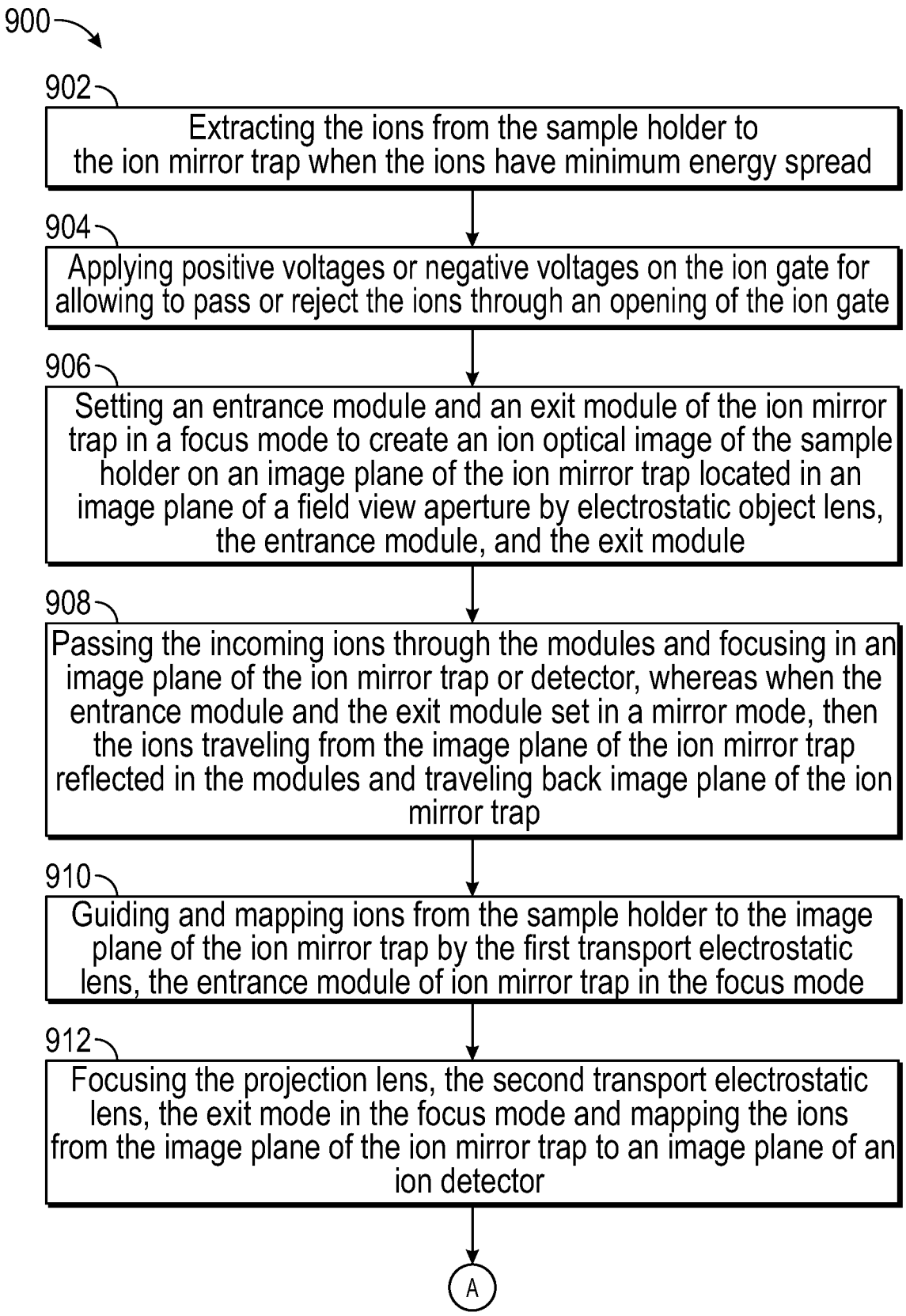
FIG. 9 is an example flow chart depicting a method for correcting timing, chromatic, and geometrical aberrations, in accordance with one or more exemplary embodiments of the present disclosure.
Figure 9:
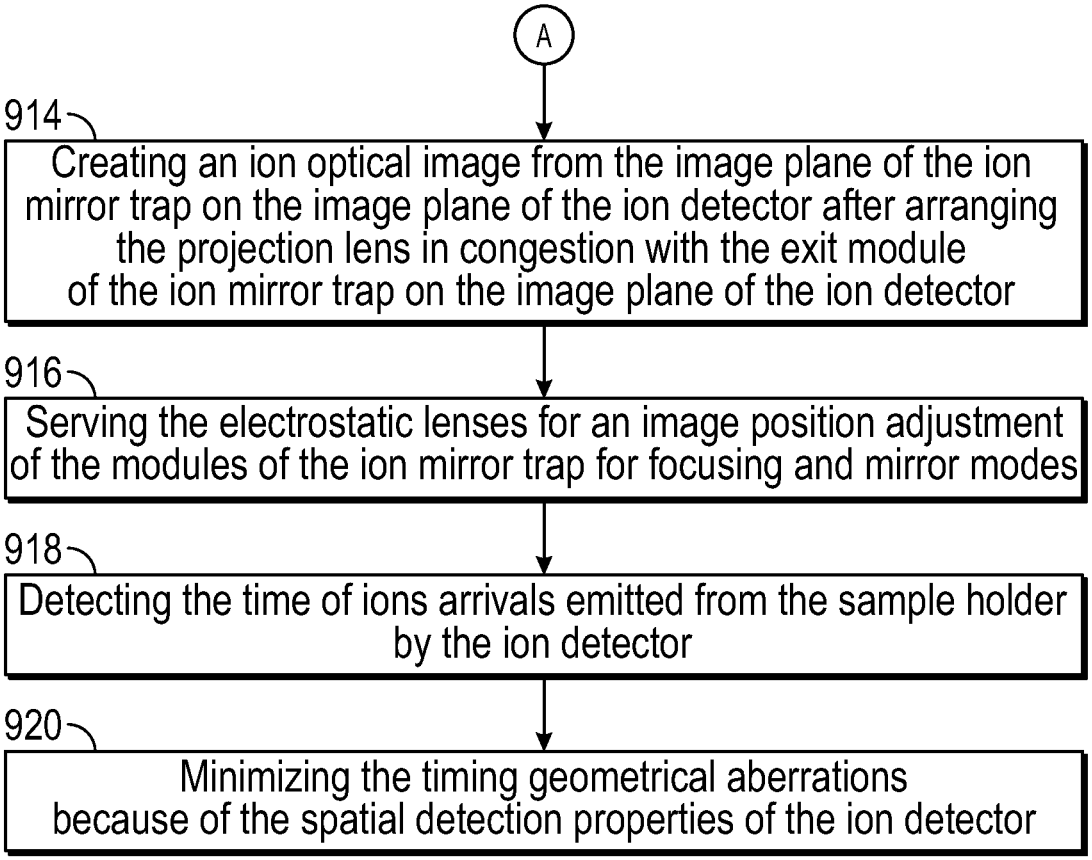

812 Improving mass and spatial resolution of an image on the image plane of the ion detector by the combination of focusing and mirroring ion-optical components with corrected geometrical, chromatic, and timed aberrations FIG. 9, 900 discloses a method for correcting timing, chromatic, and geometrical aberrations

902 Extracting the ions from the sample holder to the ion mirror trap when the ions have minimum energy spread

904 Applying positive voltages or negative voltages on the ion gate for allowing to pass or reject the ions through an opening of the ion gate

906 Setting an entrance module and an exit module of the ion mirror trap in a focus mode to create an ion optical image of the sample holder on an image plane of the ion mirror trap located in an image plane of a field view aperture by electrostatic object lens, the entrance module, and the exit module

908 Passing the incoming ions through the modules and focusing in an image plane of the ion mirror trap or detector, whereas when the entrance module and the exit module are set in a mirror mode, then the ions traveling from the image plane of the ion mirror trap reflected in the modules and traveling back image plane of the ion mirror trap

910 Guiding and mapping ions from the sample holder to the image plane of the ion mirror trap by the first transport electrostatic lens, the entrance module of ion mirror trap in the focus mode

912 Focusing the projection lens, the second transport electrostatic lens, the exit mode in the focus mode, and mapping the ions from the image plane of the ion mirror trap to an image plane of an ion detector

914 Creating an ion optical image from the image plane of the ion mirror trap on the image plane of the ion detector after arranging the projection lens in congestion with the exit module of the ion mirror trap on the image plane of the ion detector

916 Serving the electrostatic lenses for an image position adjustment of the modules of the ion mirror trap for focusing and mirror modes

918 Detecting the time of ions arrivals emitted from the sample holder by the ion detector

Figure 10:
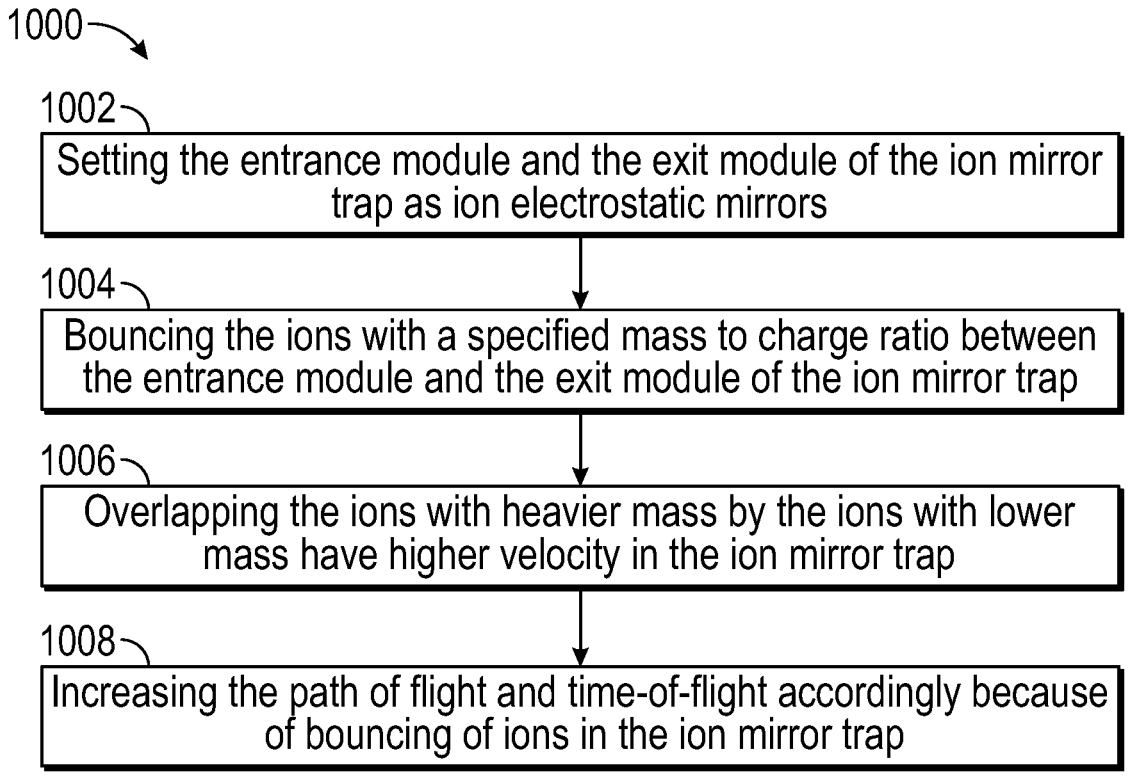
FIG. 10 is an example flow chart depicting a method for increasing the path of flight and time-of-flight, in accordance with one or more exemplary embodiments of the present disclosure.

920 Minimizing the timing geometrical aberrations because of the spatial detection properties of the ion detector FIG. 10, 1000 discloses a method for increasing the path of flight and time-of-flight

1002 Setting the entrance module and the exit module of the ion mirror trap as ion electrostatic mirrors

1004 Bouncing the ions with a specified mass to charge ratio between the entrance module and the exit module of the ion mirror trap

1006 Overpassing the ions with heavier mass by the ions with lower mass have higher velocity in the ion mirror trap

1008 Increasing the path of flight and time-of-flight accordingly because of bouncing of ions in the ion mirror trap

DETAILED DESCRIPTION OF EXAMPLE EMBODIMENTS

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application. The terms "a" and "an" herein do not denote a limitation of quantity, but rather denote the presence of at least one of the referenced item. Further, the use of terms "first", "second", and "third", and the like, herein do not denote any order, quantity, or importance, but rather are used to distinguish one element from another.

Referring to FIG. 1, FIG. 1 is a diagram 100 depicting a concept of a differentially pumped vacuum chamber and a time-of-flight mass spectrometer, in accordance with one or more exemplary embodiments of the present disclosure. The differentially pumped vacuum chamber and time-of-flight mass spectrometer 100 includes a sample vacuum cluster 101, an object lens vacuum cluster 102, a projection optical lens vacuum cluster 103, an ion mirror trap 104, electrostatic object lens 105, and projection lens 106. The ion mirror trap 104 includes an entrance module 107, two associated transport electrostatic lenses 109, 110 separated by a field view aperture 114, and an exit module 108. The projection lens 106 is separated from the ion mirror trap 104 by an aperture 115 and followed by position and time-resolved ion detector 111.

The time-of-flight mass spectrometer 100 has two types of electrostatic focusing elements such as static electrostatic focusing elements and switchable electrostatic focusing elements. The static electrostatic focusing elements include Electrostatic object lens 105, transport electrostatic lenses 109 and 110, and projection lens 106. The switchable electrostatic focusing elements include ion gate 113, the entrance module 107, the exit module 108 of the ion mirror trap 104. In the static electrostatic focusing elements, voltages on electrodes are the same during time-of-flight analyzed ions. Whereas the switchable electrostatic focusing elements, when voltages on the electrodes rapidly change from one value to another by command from the instrument's processor during time-of-flight of analyzed ions from the sample holder 112 to the ion detector 111.

In accordance with one or more exemplary embodiments of the present disclosure, the differentially pumped vacuum chamber and a time-of-flight mass spectrometer 100 may be divided into three individually pumped vacuum clusters 101, 102, 103 divided by a small opening entrance electrode 116 of the object lens 105 and an ion gate 113. The vacuum cluster 101 may be a sample vacuum cluster, the vacuum cluster 102 may be an objective lens vacuum cluster, and the vacuum cluster 103 may be a projection optical lens vacuum cluster. The time-of-flight mass spectrometer 100 may be configured to gradually reduce the gas pressure from high pressure in the sample vacuum cluster 101 to low pressure in the object lens vacuum cluster 102, the ion mirror trap 104, and a projection optical lens vacuum cluster 103. The time-of-flight mass spectrometer 100 may be configured to create a specific gas environment in sample surface area and at the same time reduce ions residual gas interaction in the projection lens cluster 103, and the ion mirror trap 104 for efficient transport of all ions to the image plane of the ion detector 111.

In accordance with one or more exemplary embodiments of the present disclosure, the time-of-flight mass spectrometer 100 includes an inlet gas channel 117 configured to deliver desired gas in the sample vacuum cluster 101, a transparent window for samples ionization radiation, and vacuum sleeves for differentially pumping gases from the vacuum clusters 101, 102, 103 of the differentially pumped vacuum chambers and a time-of-flight mass spectrometer 100. The vacuum clusters 101, 102, 103 may include gas pumping stages for differentially pumping gases from the vacuum clusters 101, 102, 103. The gas pumping stages may include, but not limited to, a first gas pumping stage (pump stage 1), a second gas pumping stage (pump stage 2), a third gas pumping stage (pump stage 3), and the like. The inlet gas channel 117 may be configured to provide gases to the sample area of vacuum cluster 101 to create specified atmosphere and gas pressure on the sample vacuum cluster 101. The differentially pumped vacuum chamber and a time-of-flight mass spectrometer 100 includes a sample holder 112 with cooling and heating capabilities positioned on the high precision movable in XYZ directions and titled in three angles manipulator. The object lens 105 may be located close to the sample holder 112 to create a diffraction image in the plane of the ion gate 113. The ion gate 113 may include, but not limited to, a skimmer shape aperture, electrically isolated gate aperture, and the like.

In accordance with one or more exemplary embodiments of the present disclosure, the transport electrostatic lenses 109, 110 may be configured to focus an ion beam in the field view aperture 114 of the ion mirror trap 104. The ion gate 113 may include the aperture on which positive voltages or negative voltages are applied. The entrance module 107 and the exit module 108 may be set in a focus mode or mirror mode. The transport electrostatic lenses 109, 110 may be configured to create an ion optical image of the sample holder 112 on the image plane of the ion mirror trap 104, located in the plane of the field view aperture 114. The object lens, the entrance module 107 in the focus mode, and the electrostatic lenses (also be known as entrance transfer lens) 109 may be configured to guide and map ions from the sample holder 112 to the image plane of the ion mirror trap 104. The electrostatic lenses 110 (also be known as exit transfer lens), the exit module 108 in the focus mode, and the projection lens 106 may be focused and map ions from the image plane of the ion mirror trap 104 to the image plane of the ion detector 111.

In accordance with one or more exemplary embodiments of the present disclosure, in the focus mode, the incoming ions pass the entrance module 107 and focus in the image plane of the ion mirror trap 104 or the ion detectors 111. Whereas, in the mirror mode, the ions traveling from the image plane of the ion mirror trap 104 are reflected in modules 107, 108 and traveling back to an image plane of the ion mirror trap 104. The projection lens 106 may be arranged and configured in congestion with the exit module 108 on the focusing mode to create the ion optical image from the image plane of the ion mirror trap 104 on the image plane of the ion detectors 111. The transport electrostatic lenses 109, 110 may be configured to adjust the image position of the entrance module 107 and the exit module 108 for focusing and mirror modes.

In accordance with one or more exemplary embodiments of the present disclosure, the ion detector 111 is also known as a position-sensitive timing detector 111. The ion detector 111 may be configured to detect the time of ions arrivals are emitted from the sample holder 112 started from the time of ionization pulse. Adjustable and movable apertures may be positioned in the ion gate 113 and field view planes of ion optical column. The ion gate 113 may include, but not limited to, diffraction, aperture, and the like.

In accordance with one or more exemplary embodiments of the present disclosure, the transport electrostatic lenses 109, 110 may be configured to receive ions with a primary component of velocity along a first direction, decelerates those ions until the no velocity in the first direction at the back of the ion mirror trap 104 and then reflect the ions back such that the ions are accelerated in a second direction that is opposite to the first direction and backs out of the ion mirror trap 104. Travel ions with bigger velocity in both directions take more time than ions with lesser velocity. In focusing transport electrostatic lenses 109, 110 ions with bigger velocity take less time than ions with lesser velocity. For this reason, combination of the transport electrostatic lenses 109, 110, the entrance module 107 and the exit module 108 in mirror mode allow compensate time arriving disturbance in the image plane of the ion detector 111. Also, the combination of the transport electrostatic lenses 109, 110, the entrance module 107 and the exit module 108 may be configured to allow to design a time-of-flight mass spectrometer with compensated timing, chromatic and geometrical aberration.

From energy conservation low time-of-flight of charge particle in electrostatic field with potential distribution $\Phi(z)$ along path length S is expressed as $$t_e = \sqrt{\frac{m}{2q}} \int_0^S \frac{dz}{\sqrt{\Phi(z)}} \tag{1}$$

there m—mass and q—charge of particle. Assuming what potential is zero their energy of charged particle is also zero. For drift space of a length S time propagation of particle with kinetic energy $\varepsilon_0$ expressed as $$t_d = S\sqrt{\frac{m}{2q}}\frac{1}{\sqrt{\varepsilon_0}} \tag{2}$$

From equations (1) and (2) for time propagation in electrostatic field $\Phi(z)$ and drift space of length S are equal ($t_e = t_d$) are defined the average energy of charge particle in electrostatic field length S as $$\bar{\varepsilon} = \frac{S^2}{\left[\int_0^S \frac{dz}{\sqrt{\Phi(z)}}\right]^2} \tag{3}$$

Let's define normalized time propagation in path of length S as $\tau$ and then for path of the length $S_i$ the normalized time may be expressed as $$\tau_i = \frac{S_i}{\sqrt{2q\varepsilon_i}} \tag{4}$$

Accordingly, time-of-flight of charge particle mass $m_i$ with trajectory length $S_i$ will be expressed as $$t_i = \tau_i\sqrt{m_i} \tag{5}$$

Mass resolution Time-of-Flight mass spectrometers them ion mass m and m+Δm may be separated on detector plane express in time-of-flight parameter as $$RSm = m/\Delta m = T/2\Delta t \tag{6}$$

there T—time-of-flight ion mass m from the sample to detector plane and

Δt—ions time arriving divergence on the ion detector 111 due the jitter of detector on time-of-flight calculation on detector, pulse duration of ionization source on the sample and timing, temporal chromatic and geometrical aberration of time-of-flight mass spectrometer.

Spatial resolution of imaging mass spectrometer on imaging plane of the ion detector 111 defined as $$RSs = \Delta s/M \tag{7}$$

there Δs—is size of the image on the ion detector 111 from pointed source of ions from sample plane and M—linear magnification of time-of-flight mass spectrometer on the ion detector's plane.

Δs—defined by value of chromatic and geometrical aberrations of time-of-flight mass spectrometers. These aberrations depend on overall design of time-of-flight mass spectrometer.

As followed from equation (6) mass resolution increase with time-of-flight T and means with longer path of flight for specified velocity of ions. Also, second factor is timing aberrations of time-of-flight mass spectrometer, which may be corrected or minimized with appropriate ion optical design of an analyzer.

For imaging mass spectrometer spatial resolution equation (7) is second dominated factor in analytical parameters and may be improved by correcting and minimizing and correcting the geometrical and chromatic aberrations of the instruments.

Two additional major parameters that define the analytical parameter of analyzer are its sensitivity Qm and transparency Qt.

The transparency of time-of-flight mass spectrometer may be defined as ratio the number of ions arrived on the ion detector's plane 111 Ia to the number of ions emitted from the sample holder 112 Is in one pulse.

$$Qt=Ia/Is \tag{8}$$

and mostly defined by configuration of ion optical component and the systems design in all.

The sensitivity of analyzer may be defined as ratio the number of ions registered by the ion detector 111 to the number of ions emitted from the sample holder 112 Ir in one pulse.

$$Qm=Ir/Is \tag{9}$$

In accordance with one or more exemplary embodiments of the present disclosure, the imaging time-of-flight mass spectrometer 100 may be set in a multi-pass mode when from a range of ions emitted by the sample holder 112 with masses between $M_1$ and $M_4$ there $M_1$—lighter mass and $M_4$—heaviest ion mass from a full spectrum of ions ($M_1<M_4$), the subset of ion masses between $m_2$ and $m_3$ there $m_2<m_3$ from full ions mass spectrum in the range of $M_1$ and $M_4$ ($M_1<m_2<m_3<M_4$) are passed inside of the ion mirror trap 104 and finally focused on the ion detector 111. Here, the ions are single charged. For multi-charged ions mass of ions in all above and following expressions has to be substituted by ions mass to charge ratio. The sensitivity and transparency of an analyzer depend on the sensitivity and effectiveness of the ion detector 111. Mass range of ions may be analyzed from the sample holder 112 by a selection of time then the ion gate 113 configured to pass the ions inside of the ion mirror trap 104 is open and time then the ion mirror trap 104 is closed. Multiple bouncing of a selected ion with specified mass to charge ratio allows increase an ions path of flight and accordingly control in a wide range the ion mass resolution.

Referring to FIG. 2, FIG. 2 is an ion optical schematic diagram 200 depicting the time-of-flight mass spectrometer in a projection mode, in accordance with one or more exemplary embodiments of the present disclosure. The time-of-flight mass spectrometer 200 includes the object lens 105, the entrance module 107, the associated transport electrostatic lenses 109, 110, the exit module 108, projection lens 106, and the ion detector 111. The projection mode may be presented when all ions from the sample holder 112 transport along a straight optical axis of instruments and focusing and mapped to the ion detector 111. In the projection mode, the time-of-flight mass spectrometer 200 is optimized for minimum timed, a chromatic and geometrical aberration. The parameters of the sample holder 112 (for example, an ions source) and the time-of-flight mass spectrometer 200 may be used to define transmission rate, spatial, and ions mass resolution. Advantage of the projection mode that magnified image of the sample holder 112 in all range of emitted ions masses from the sample holder 112 created on the image plane of the ion detector 111. The ions optical components may include, but not limited to, the object lens 105, the entrance module 107, transport electrostatic lenses 109, 110, the exit module 108, the projection lens 106, and the like. The ions optical components may be set as focusing ions electrostatic lenses. In Projection mode, the ion optical components are static. The ion Gate 113 in the open mode and voltages on electrodes of the ion optical components are set to produce the image of the sample on the image plane of the ion detector 111 with maximum spatial and mass resolution.

Because the time-of-flight mass spectrometer 200 has a straight optical axis only the third-order geometrical and second-order chromatic aberration and higher orders is present. The spatial detection properties of the ion detector 111 may be configured to minimize the timing of geometrical aberrations. The major aberration effect on the mass resolution has timing-chromatic aberration of the system because the ions emitted from the sample holder 112 have an energy spread defined by an ionization source (shown in FIG. 1) of the instrument.

For Projection mode of time-of-flight mass spectrometer 200 (no ions bouncing in the ion mirror trap 104), overall flight path $S_{proj}$ is the sum of optical lengths $S_o$—of object lens 105, $S_e$—of the Ion mirror Trap 104 and $S_p$—of the projection lenses 106:

$$S_{proj}=S_o+S_t+S_p$$

And accordingly, time-of-flight in expressed as $$t_{proj}=\frac{S_{proj}}{\sqrt{2q\varepsilon}}\sqrt{m}$$

Referring to FIG. 3, FIG. 3 is an ion optical schematic diagram 300 depicting the time-of-flight mass spectrometer in a close mode of the ion gate, in accordance with one or more exemplary embodiments of the present disclosure. In multi-pass mode of operations (refer FIG. 7) from the time $t_1$ when pulse of ions is created on the sample holder 112 in the ion source up to the time $t_2$, from expression (5), when the ions with mass m2 are reached the ion gate 113, this ion gate 113 in the close mode and under electrical potential which reject the ions to pass through this ion gate 113 and enter into the entrance module 107 and the exit module 108 of the ion mirror trap 104. From time $t_2$ up to time $t_3$ (the time when ion with mass $m_3$ reached the ion gate 113) ion gate 113 may be in open mode. From time $t_3$ up to time $t_5$ when ions mass $m_3$ reach the ion detector 111, the ion gate 113 may be in the close mode.

Referring to FIG. 4, FIG. 4 is an ion optical schematic diagram 400 depicting a time-of-flight mass spectrometer in an open mode of the ion gate, in accordance with one or more exemplary embodiments of the present disclosure. From time $t_2$ up to time $t_3$ (the time when ion with mass $m_3$ reached the ion gate 113) ion gate 113 may be in the open mode. After time $t_3$ the ion gate 113 in the close mode. Ions with masses between $m_2$ and $m_3$ may only enter in the ion mirror trap 104. From the time $t_1$, the entrance module 107 of the ion mirror trap 104 may be set (refer FIG. 7) in the focusing mode (FIG. 4) and the Exit module 108 in the mirror mode. The ion gate 113 is in the close mode until ion with mass $m_2$ at the time t2 may be in the plane of ion gate 113.

Referring to FIG. 5, FIG. 5 is an ion optical schematic diagram 500 depicting a time-of-flight mass spectrometer in the ion mirror trap bouncing mode, in accordance with one or more exemplary embodiments of the present disclosure. From the time $t_3$, then ions with mass $m_3$ are reached the ion gate 112, the entrance module 107 of the ion mirror trap 104 are set (refer FIG. 7) in the mirror mode and the exit module 108 is also in the mirror mode. From the time $t_3$, up to time $t_4$, of end bouncing ions in the ion mirror trap 104, the Entrance module 107 of the ion mirror trap 104 are set (refer FIG. 7) in the mirror mode (as shown in FIG. 4) and the exit module 108 in the mirror mode. From time $t_4$ the exit module 108 is in focusing mode and ions are living on ion mirror trap 104 and focusing by the projection lens 106 on the image plane of ion detector 111 When the entrance module 107 and the exit module 108 are set as ion electrostatic mirrors and ions bounce between these modules 107, 108.

In the ion mirror trap 104 on bouncing mode ions with low masses have higher velocity and may overpass the heavier ions. Conditions when ion with masses between $m_2$ and $m_3$ ($m_2<m_3$) no overpassing in the ion mirror trap 104 with effective length S defined by as $$m_3/m_2=\left(1+2\frac{\tau_3}{\tau_2}\right)^2 \tag{10}$$

The normalized time $\tau_2$ and $\tau_3$ defined in equation (4) as function of the effective length of ion mirror trap $S_t$ and effective energy of ions in expression (3).

In period between entrance time $t_2$ and exit time $t_4$ in ion mirror trap 104, ions with mass $m_2$ bouncing in the ion mirror trap 104. In case when ions in passing ion mirror trap 104 *n* times, the exit time $t_4$ defines as $$t_4=t_2+(2n+1)\tau_2\sqrt{m_2} \tag{11}$$

there $\tau_2$—normalized entrance time (5) of ion mass $m_2$ in the Ion mirror Trap 104.

Maximum number of passes n in the ion mirror trap 104 for mass $m_2$ not overpassed with ions of heavier masses $m_3$ expressed as $$n \leq \frac{1}{2}\frac{k+1}{k-1} \tag{12}$$

there $$k=\sqrt{\frac{m_3}{m_2}} \tag{13}$$

Expression (12) define the mass range which may enter the ion mirror trap 104 with no overpassing condition for a specified number of passes n, and accordingly overall length of ions axial trajectory in the mass spectrometer.

Mass Resolution of Imaging Time-of-Flight Mass Spectrometers

Mass resolution RS of Time-of-Flight mass spectrometers as function of ion mass m defined as $$RS(m)=t(m)/2\Delta t \tag{14}$$

The t(m)—time-of-flight of ions with mass m from the ion source 112 to the ion detector 111 and Δt—the aberration of flight time due to the spread of ions initial energy on the ion source 112, a difference of path length of ions moved on different trajectories along ion optic axis of instruments, the detectors timing jitter. Bouncing of ions in the ion mirror trap 104 increases the path of flight and time-of-flight accordingly. It means the presented schematic and operation of imaging mass spectrometers increase the analytical parameters of TOF mass spectrometers by ions multi-passing in the time-of-flight mass spectrometer of the proposed instruments.

For Projection mode of instrument (no ions bouncing in the ion mirror trap 104), as described in the first embodiment, overall flight path $S_{proj}$ is the sum of optical lengths $S_o$—of object lens 105, $S_t$—of the ion mirror trap 104 and $S_p$—of the projection lenses 106:

$$S_{proj}=S_o+S_t+S_p \tag{15}$$

And accordingly, time-of-flight in (14) expressed as $$t_{proj}=\frac{S_{proj}}{\sqrt{2q\varepsilon}}\sqrt{m} \tag{16}$$

In multi-pass mode with n passes in the ion mirror trap 104, the length of ions axial path from the sample to the ion detector 111 will be expressed as $$S_{mpass}=S_o+nS_t+S_p \tag{17}$$

and time-of-flight as accordingly $$t_{mpass}=\frac{S_{mpass}}{\sqrt{2q\varepsilon}}\sqrt{m} \tag{18}$$

For example, for ions with mass ratio $m_3/m_2=1.1$ (it is equal 10% mass difference) number of passes n in Ion Trap 104, to satisfy "not mass overpassing" expression (12) has to be no more than 20.

In case of equal the optical length $S_o$ of Object Lens 105, $S_t$ of Ion Trap 104 and Projection Lens $S_p$ 106 ($S_o=S_t=S_p=S$) the length $S_{mpass}$ of multi-pass optical axis as (17)

$$S_{mpass}S+20*S+S=22*S$$

is at seven time bigger than length of direct optical axis (15)

$$S_{proj}=S+S+S=3*S$$

It means that $S_{mpass}/S_{proj}=22/3$. Accordingly, time-of-flight and mass resolution in multi-pass mode at least seven-time higher than direct imaging mode of mass spectrometers. Accordingly (14), multi-pass mode of instrument, for this example, has at least a seven-time higher mass resolution then Projection mode. Second member in expression for mass resolution (14) is timing aberrations Δt, there most significant part has chromatic aberration due to energy spread of emitted ions from the sample.

Spatial Resolution of Imaging Time-of-Flight Mass Spectrometers

Spatial resolution of the imaging mass spectrometer on the imaging plane of the ion detector 111 defined as $$RSs\ [\text{mm}]=\Delta s/M \quad (17)$$

there M—linear magnification of time-of-flight mass spectrometer of instruments and Δs—distortions of the image on detectors image plane by geometrical and chromatic aberrations of the time-of-flight mass spectrometer.

There are two major approaches to improve spatial resolution of projection the time-of-flight mass spectrometer as imaging TOF mass spectrometer. One—is optimized focusing properties of ion optical components of the instrument by using ion lenses with minimum aberrations. Second is designing the spectrometer with corrected aberrations. It means time-of-flight mass spectrometer incorporate components with aberrations of opposite signs. In overall time-of-flight mass spectrometer this will allow to compensated the chromatic and geometrical aberrations of the time-of-flight mass spectrometers and finally achieve the higher spatial resolution.

Particularly well known that electrostatic axial symmetrical mirrors and electrostatic axial symmetrical lenses have apposite sign of aberrations and effectively used in projection electron spectrometers and microscopy. Also, these components have opposite sign of temporal chromatic aberration because charge particle with higher velocity spend more time in mirror then particles with less velocity.

Also, the electrostatic time-of-flight mass spectrometer of proposed instrument has axial symmetry and only third, higher order of geometrical aberrations needs to be compensated.

Referring to FIG. 6, FIG. 6 is an example ion optical schematic diagram 600 depicting the exit module of the ion mirror trap in the focusing mode and projection of an ion beam on an image plane of the ion detector, in accordance with one or more exemplary embodiments of the present disclosure. The ion optical schematic diagram 600 includes time-of-flight T3, and mass of ions M2. The exit module 108 of the ion mirror trap 104 may be set in the focusing mode in conjunction with the projection lens 106 to create an image from the image plane of the ion mirror trap 104 on the plane of the ion detector 111. The exit module 108 is in the focusing mode and the ion beam 602 is focused by the projection lens 106 on the image plane of the ion detector 111 In the transport electrostatic lenses 109, 110 the ions with bigger velocity take less time than ions with lesser velocities. For this reason, the combination of the exit module 108, the entrance module 107, and the transport electrostatic lenses 109, 110 allow for compensating time arriving disturbance in the image plane of the ion detector 111. Also, the combination of the exit module 108, the entrance module 107, and the transport electrostatic lenses 109, 110 allow designing the ion optical system with compensated chromatic and geometrical aberration.

When the entrance module 107 and the exit module 108 are set as ion electrostatic mirrors and ions bounce between the entrance module 107 and the exit module 108. The ion mirror trap 104 is a device that receives ions with a primary component of velocity along a first direction, decelerates those ions until they have no velocity in the first direction at the back of the ion mirror trap 104, and then reflect the ions back such that they are accelerated in a second direction that is opposite to the first direction and backs out of the ion mirror trap 104. Travel ions with bigger velocities in both directions take more time than the ions with lesser velocities. In focusing transport electrostatic lenses 109, 110 ions with bigger velocity take less time than ions with less velocity. For this reason, a combination of electrostatic mirrors 107, 108 and focusing lenses 109, 110 allow compensating time arriving disturbance in the image plane of the ion detector. Also, a combination of ion mirror trap 104 with transport electrostatic lenses 109, 110 allows designing an ion optical system with compensated chromatic and geometrical aberration.

Referring to FIG. 7, FIG. 7 is an example functionality diagram 700 depicting an ion mirror trap 104 on a time scale 702, in accordance with one or more exemplary embodiments of the present disclosure. The ion mirror trap 104 includes the ion gate 113, the entrance module 107, and the exit module 109. The time scale 702 includes time $t_1$, $t_2$, $t_3$, and $t_4$. Time $t_1$ is the start time of ions from the sample holder 112, time $t_2$ is the time when ions of mass $m_2$ are reached the ion gate 113, $t_3$ is the time when ions of mass m3 are reached the ion gate 113. Time $t_4$ is the time when ions of mass m3 leave the ion mirror trap 104. The time $t_5$ is the time when ions of mass m3 reached the plane of the ion detector 111.

In accordance with one or more exemplary embodiments of the present disclosure, the ion gate 113 may be in two states. The two states may include, but not limited to, a closed state, an open state, and the like. The closed state may occur when the applied voltage on the ion gate 113 created the potential barrier and the ions may not pass the ion gate 113. Whereas the open state may occur when the voltage has not created the potential barrier and the ions may pass through the ion gate 113. The entrance module 107 and the exit module 108 of the ion mirror trap 104 may be in two states. The two states may include, but not limited to, a mirror state, a focus/lens state, and the like. The mirror state is when ions entering in the entrance module 107 along the optical axis deaccelerated inside the module and then sent back and focusing in the mirror's imaging plane. The focusing state is when the entrance module 107 acting as an ion optical lens, ion entering in the entrance module 107 along the optical axis, passing throw, and focusing in the imaging plane of the lens.

Run Time Operation and Ion Optical Component Control

The time-of-flight mass spectrometer of mass spectrometer has two types of electrostatic focusing elements. The first type of electrostatic focusing elements includes the electrostatic object lens 105, the first transport electrostatic lens 109, the second electrostatic 110, and the projection lens 106. The second type of electrostatic focusing elements includes the ion gate 113, the entrance module 107, and the exit module 108 of the ion mirror Trap 104.

1. Static, which voltages on electrodes are the same during time-of-flight of analyzed ions.
2. Switchable—when voltages on electrodes rapidly change from one value to another by command from the instrument's processor during time-of-flight of analyzed ions from the source holder 112 to the ion detector 111.

The ion gate 113 may be in a closed state and an open state. The closed state is when on the ion gate 113 applied voltage created the potential barrier and ions may not pass aperture. Open state is when voltage not created the potential barrier and ions may pass throw aperture.

The entrance module 107 and the exit module 108 of the ion mirror trap 104 may be in mirror state and focus state. The mirror state is when the ions entering in the entrance module 107 along the optical axis deaccelerated inside the entrance module 107 and then sent back and focusing in the mirror's imaging plane. The focusing state is when the entrance module 107 acting as an ion optical lens, ions entering the entrance module 107 along the optical axis, passing throw and focusing in the lens's imaging plane.

In the projection mode of the mass spectrometer's operation, all ion optical components are static. The ion gate 113 is in an open mode and voltages on electrodes of ion optical components are set to produce the image of the sample on the detector plane with maximum spatial and mass resolution.

In Multi-pass mode, when defined subset of ion masses between $m_2$ and $m_3$ ($m_2<m_3$) are analyzed, the switchable components change the voltages and modes of operations in specified sequence:

1. The ion gate aperture 113 is in the close mode until the ion with mass $m_2$ at the time $t_2$ will be in the image plane of the aperture. From time $t_2$ up to time $t_3$ (time when ion with mass $m_3$ reach the plane of aperture) ion gate aperture in the open mode. After time $t_3$ aperture in the close mode. Ions with masses between $m_2$ and $m_3$ will only enter in the ion mirror trap 104.
2. Entrance module 107 of ion mirror trap 104 from start pulse time $t_1$ up to time $t_3$ in the focusing mode and the array of object lens 105, the entrance module 107 and the first transport electrostatic lens 109 are set to create the sample's image in plane of field view aperture 114. From time $t_3$ up to time $t_5$ the Entrance module 107 is in Mirror mode. Time $t_5$ is time when ions with mass $m_3$ are reach detector plane.
3. Exit module 108 of ion mirror trap 104 from time start of ion pulse $t_1$ up to time $t_4$ in Mirror mode and are set, in conjunction with second transport electrostatic lens 110, to create back image on plane of field view aperture 114. From time $t_4$ up to time $t_5$ it is set in Focusing mode and in conjunction with Projection lens 106 to create the image from the plane of field view aperture 114 on the image plane of the ion detector 111 On FIG. 7 presented a timed diagram of Ion trap Entrance and Exit modules 107, 108.

The diapason of ions masses between $m_2$ and $m_3$ ($m_2<m_3$) and switch times $t_3$ and $t_4$ defined from non-overpassing conditions (10) and (12).

Referring to FIG. 8, FIG. 8 is an example flow chart 800 depicting a method for improving mass and spatial resolution of an image, in accordance with one or more exemplary embodiments of the present disclosure. The method 800 may be carried out in the context of the details of FIG. 1, FIG. 2, FIG. 3, FIG. 4, and FIG. 5, FIG. 6, and FIG. 7. However, the method 800 may also be carried out in any desired environment. Further, the aforementioned definitions may equally apply to the description below.

The method commences at step 802, selecting analyzed ions mass range from a sample holder by a selection of time then an ion gate for passing the ion inside of an ion mirror trap is open and time then the ion mirror trap is closed. Thereafter, at step 804, receiving the ions with a primary component of velocity along a first direction to the ion mirror trap and decelerating the ions until no velocity in the first direction at back of the ion mirror trap and then reflecting the ions back such that the ions are accelerated in a second direction that is opposite to the first direction and back out of the ion mirror trap. Thereafter, at step 806, traveling the ions with a bigger velocity in the first direction and the second direction takes more time than the ions with lesser velocities, whereas in focusing electrostatic lenses ions with bigger velocities take less time than the ions with lesser velocities. Thereafter, at step 808, bouncing of a selected ion with a specified mass to charge ratio allow increase ions path of flight and accordingly control in a wide range the ion mass resolution. Thereafter, at step 810, compensating time arriving disturbance in an image plane of an ion detector by a combination of focusing and mirroring ion optical components. Thereafter, at step 812, improving mass and spatial resolution of an image on the image plane of the ion detector by the combination of focusing and mirroring ion optical components with corrected geometrical, chromatic, and timed aberrations.

Referring to FIG. 9, FIG. 9 is an example flow chart 900 depicting a method for correcting timing, chromatic, and geometrical aberrations, in accordance with one or more exemplary embodiments of the present disclosure. The method 900 may be carried out in the context of the details of FIG. 1, FIG. 2, FIG. 3, FIG. 4, and FIG. 5, FIG. 6, FIG. 7, and FIG. 8. However, the method 900 may also be carried out in any desired environment. Further, the aforementioned definitions may equally apply to the description below.

The method commences at step 902, extracting the ions from the sample holder to the ion mirror trap when the ions have minimum energy spread. Thereafter, at step 904, applying positive voltages or negative voltages on the ion gate for allowing to pass or reject the ions through an opening of the ion gate. Thereafter, at step 906, setting the entrance module and the exit module of the ion mirror trap in a focus mode to create the ion optical image of the sample holder on an image plane of the ion mirror trap located in an image plane of a field view aperture by electrostatic object lens, the entrance module, and the exit module. Thereafter, at step 908, passing the incoming ions through the modules and focus in an image plane of the ion mirror trap or detector, whereas when the entrance module and the exit module are set in a mirror mode, then the ions traveling from the image plane of the ion mirror trap reflected in the modules and traveling back image plane of the ion mirror trap. Thereafter, at step 910, guiding and mapping ions from the sample holder to the image plane of the ion mirror trap by the first transport electrostatic lens, the entrance module of the ion mirror trap in the focus mode.

Thereafter, at step 912, focusing the projection lens, the second transport electrostatic lens, the exit mode in the focus mode, and mapping the ions from the image plane of the ion mirror trap to an image plane of an ion detector. Thereafter, at step 914, creating an ion optical image from the image plane of the ion mirror trap on the image plane of the ion detector after arranging the projection lens in congestion with the exit module of the ion mirror trap on the image plane of the ion detector. Thereafter, at step 916, serving the electrostatic lenses for an image position adjustment of the modules of the ion mirror trap for focusing and mirror modes. Thereafter, at step 918, detecting the time of ions arrivals emitted from the sample holder by the ion detector. Thereafter, at step 920, minimizing the timing geometrical aberrations because of the spatial detection properties of the ion detector.

Referring to FIG. 10, FIG. 10 is an example flow chart 1000 depicting a method for increasing the path of flight and time-of-flight, in accordance with one or more exemplary embodiments of the present disclosure. The method 900 may be carried out in the context of the details of FIG. 1, FIG. 2, FIG. 3, FIG. 4, and FIG. 5, FIG. 6, FIG. 7, and FIG. 8. However, the method 900 may also be carried out in any desired environment. Further, the aforementioned definitions may equally apply to the description below.

At step 1002, Setting the entrance module and the exit module of the ion mirror trap as ion electrostatic mirrors.

Thereafter, at step 1004, bouncing the ions with a specified mass to charge ratio between the entrance module and the exit module of the ion mirror trap. Thereafter, at step 1006, overpassing the ions with heavier mass by the ions with lower mass have higher velocity in the ion mirror trap. Thereafter, at step 1008, Increasing the path of flight and time-of-flight accordingly because of the bouncing of ions in the ion mirror trap.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A time-of-flight mass spectrometer with a straight ion optical axis comprising:

a vacuum chamber divided into a sample vacuum cluster 101, an objective lens vacuum cluster 102, and an ion formational and projection optical lens vacuum cluster 103;

a sample holder 112 configured to manipulate, heat, cool the sample vacuum cluster 101 to provide access for a radiation source, pulse light or charged particle beam, to illuminate, evaporate and ionize a sample on the sample holder 112 from the sample vacuum cluster 101;

an electrostatic object lens 105 from the objective lens vacuum cluster 102 configured to extract, formation, and transport a plurality of ions of the sample on the sample holder 112 from the sample vacuum cluster 101 to an ion mirror trap 104 of the ion formational and projection optical lens vacuum cluster 103;

an ion gate 113 being an electrically insolated electrode on which applied voltages allow to reject or pass the plurality of ions through an opening of the ion gate 113, the ion mirror trap 104 comprising an entrance module 107 and an exit module 108 set in a focus mode or mirror mode, and a first transport electrostatic lens 109, and a second transport electrostatic lens 110 configured to create an ion optical image on an image plane located in a plane of a field view aperture 114, whereby the electrostatic object lens 105, the entrance module 107 in the focus mode and the first transport electrostatic lens 109 configured to guide and map the plurality of ions from the sample on the sample holder 112 to the image plane of the field view aperture 114, the second transport electrostatic lens 110, the exit module 108 in the focus mode and a projection lens 106 focusing and mapping the plurality of ions from the image plane of the field view aperture 114 to an image plane of an ion detector 111, the projection lens 106 configured to form an ion optical image of the sample on the sample holder 112 on the image plane of the ion detector 111; and a combination of focusing and mirroring ion optical components with corrected geometrical, chromatic, and timed aberrations configured to compensate time arriving disturbance in the image plane of the ion detector 111 and improve mass and spatial resolution of an image on the image plane of the ion detector 111, the combination of focusing and mirroring ion optical components comprising the electrostatic object lens 105, the entrance module 107, the first electro statistic transport lens 109, the second electro statistic transport lenses 110, the exit module 108, and the projection lens 106.

2. The time-of-flight mass spectrometer of claim 1, wherein the ion detector 111 is configured to detect an arrival time of the plurality of ions emitted from the sample on the sample holder 112 started from the time of ionization pulse.

3. The time-of-flight mass spectrometer of claim 1, wherein the sample vacuum cluster 101 comprising an inlet gas channel configured to provide controlled delivery of specified gases to create specified atmosphere and gas pressure on the sample holder 112.

4. The time-of-flight mass spectrometer of claim 1, wherein the entrance module 107 and the exit module 108 are operated in operational modes comprising: I) the focusing mode is defined when the entrance module 107 and the exit module 108 are set as ions focusing elements; II) an entrance mode is defined when the entrance module 107 is set as ions focusing elements and the exit module 108 is set as an ion electrostatic mirror; III) a bouncing mode is defined when the entrance module 107 and the exit module 108 are set as ion electrostatic mirrors and the plurality of ions bouncing between the entrance module 107 and the exit module 108; and IV) an exit mode is defined when the entrance module 107 is set as an ion electrostatic mirror and the exit module 108 is set as the ions focusing element.

5. The time-of-flight mass spectrometer of claim 4, wherein the ion electrostatic mirrors 107, 108, the first electro statistic transport lens 109, the second electro statistic transport lens 110 and projection lens 106 are configured to compensate timing, chromatic and geometrical aberrations.

6. The time-of-flight mass spectrometer of claim 1, wherein the electrostatic object lens 105 with a small opening in an electrode is configured to allow differential gas pumping in the vacuum chamber and create gas atmosphere and pressure in the sample vacuum cluster 101.

7. The time-of-flight mass spectrometer of claim 1, wherein the ion mirror trap 104 is configured to allow bouncing the plurality of ions with specified masses to create aberration of corrected image of the sample on the sample holder 112 on the image plane of the ion detector 111.

8. The time-of-flight mass spectrometer of claim 1, wherein the combination of focusing and mirroring ion optical components are configured to operate in the operational modes during an ion beam propagation for setting a mass range of the plurality of ions from the sample on the sample holder 112.

9. The time-of-flight mass spectrometer of claim 1, wherein the electrostatic object lens 105 is located close to the sample holder 112 to create a diffraction image in an image plane of the ion gate 113.

10. The time-of-flight mass spectrometer of claim 1, wherein the first electro statistic transport lens 109, the second electro statistic transport lenses 110 are configured to serve for an image position adjustment of the entrance module 107 and the exit module 108 for the focusing and mirror modes.

11. The time-of-flight mass spectrometer of claim 1, wherein the mirror mode of the entrance module 107 and the exit module 108 is occurred when the plurality of ions entering along the straight ion optical axis deaccelerated inside the entrance module 107 and the exit module 108 and send back and focus in a mirror's multi-reflecting plane.

12. The time-of-flight mass spectrometer of claim 1, wherein the focus mode of the entrance module 107 and the exit module 108 is occurred when the plurality of ions entering in the entrance module 107 and the exit module 108 along the straight ion optical axis, passing throw and focusing in a lens's imaging plane.

13. The time-of-flight mass spectrometer of claim 1, wherein the object lens 105, the entrance module 107, the first electro statistic transport lens 109, the second electro statistic transport lenses 110, the exit module 108, and the projection lens 106 are static when a projection mode is presented.

14. The time-of-flight mass spectrometer of claim 13, wherein the ion gate 113 is in an open mode and voltages on electrodes of a plurality of ion optical components are set to produce a sample image on the image plane of the ion detector 111 with maximum spatial and mass resolution.

15. A method for improving mass and spatial resolution of an image, comprising:

selecting a plurality of analyzed ions mass range from a sample on a sample holder 112 by a selection of time when an ion gate 113 for passing a plurality of ions inside of an ion mirror trap 104 is open and time when the ion mirror trap 104 is closed;

receiving the plurality of ions with a primary component of velocity along a first direction to the ion mirror trap 104 and decelerating the plurality of ions until no velocity in the first direction at back of the ion mirror trap 104 and then reflecting the plurality of ions back such that the plurality of ions is accelerated in a second direction that is opposite to the first direction and backs out of the ion mirror trap 104;

traveling the plurality of ions with bigger velocities in the first direction and the second direction takes more time than the plurality of ions with lesser velocities, whereas in focusing electrostatic lenses 109, 110 ions with bigger velocities take lesser time than the plurality of ions with lesser velocities;

bouncing selected ion with a specified mass to charge ratio allow increase ions path of flight and accordingly control in a wide range of the ion mass resolution;

compensating time arriving disturbance in an image plane of an ion detector 111 by a combination of focusing and mirroring ion optical components, the focusing and mirroring ion optical components comprising an object lens 105, an entrance module 107, a first electro statistic transport lens 109, a second electro statistic transport lenses 110, an exit module 108, and a projection lens 106 and the ion detector 111; and improving mass and spatial resolution of an image on the image plane of the ion detector 111 by the combination of focusing and mirroring ion optical components with corrected geometrical, chromatic, and timed aberrations.

16. A method for correcting timing, chromatic, and geometrical aberrations, comprising:

extracting a plurality of ions from a sample on a sample holder 112 to an ion mirror trap 104 when the plurality of ions has minimum energy spread;

applying positive voltages or negative voltages to an ion gate 113 for allowing to pass or reject the plurality of ions through an opening of the ion gate 113;

setting an entrance module 107 and an exit module 108 of an ion mirror trap 104 in a focus mode to create an ion optical image of the sample on the sample holder 112 on an image plane of the ion mirror trap 104 located in an image plane of a field view aperture 114 by an electrostatic object lens 105, a first transport electrostatic lens 109, a second transport electrostatic lens 110, the entrance module 107, and the exit module 108;

passing the plurality of ions through the entrance module 107 and the exit module 108 and focusing the plurality of ions on an image plane of the ion mirror trap 104 or an ion detector 111, whereas when the entrance module 107 and the exit module 108 set in a mirror mode, then the plurality of ions traveling from the image plane of the ion mirror trap 104 reflected in the entrance module 107, and the exit module 108 and traveling back the image plane of the ion mirror trap 104;

guiding and mapping the plurality of ions from the sample on the sample holder 112 to the image plane of the ion mirror trap 104 by the electrostatic object lens 105, the first transport electrostatic lens 109, the entrance module 107 of the ion mirror trap 104 in the focus mode, whereby the second transport electrostatic lens 110, the exit Module 108 in the focus mode and projection lens 106 focusing and mapping the plurality of ions from the image plane of field view aperture 114 to the image plane of the ion detector 111;

creating an ion optical image from the image plane of the ion mirror trap 104 on the image plane of the ion detector 111 after arranging the projection lens 106 in congestion with the exit module 108 of the ion mirror trap 104;

serving the first transport electrostatic lens 109 and the second transport electrostatic lens 110 for an image position adjustment of the entrance module 107, and the exit module 108 for the focus mode and the mirror mode;

detecting the time arrivals of the plurality of ions emitted from the sample on the sample holder 112 by the ion detector 111; and minimizing timing, chromatic, geometrical aberrations of spatial detection properties of the ion detector 111.

17. The method of claim 16, further comprising a step of setting the entrance module 107 and the exit module 104 of the ion mirror trap 108 as ion electrostatic mirrors.

18. The method of claim 17, further comprising a step of bouncing the plurality of ions between the entrance module 107 and the exit module 108 of the ion mirror trap 104.

19. The method of claim 18, further comprising a step preventing of overpassing the plurality of ions with a heavier mass by the plurality of ions with a lower mass having higher velocity in the ion mirror trap 104.

20. The method of claim 19, further comprising a step of increasing a path of flight and a time of flight accordingly bouncing of the plurality of ions in the ion mirror trap 104.

* * * * *